US005088442A

United States Patent [19]

Joson et al.

[11] Patent Number: 5,088,442

[45] Date of Patent: Feb. 18, 1992

[54] DEVICE FOR SELECTIVELY MOISTENING ENVELOPE FLAPS

[75] Inventors: Michel Joson, Fontenay Tresigny; Jean-Pierre Gregoire, Bagneux, both of France

[73] Assignee: Societe Anonyme dite: ALCATEL SATMAM, Bagneux, France

[21] Appl. No.: 585,453

[22] Filed: Sep. 20, 1990

[30] Foreign Application Priority Data

Sep. 28, 1989 [FR] France ..... 89 12706

[51] Int. Cl.[5] ..... B05C 1/00; B05C 1/06

[52] U.S. Cl. ..... 118/238; 118/264; 156/442.2

[58] Field of Search ..... 118/264, 270, 238, 247, 118/500, 268; 156/442.2, 442.1

[56] References Cited

U.S. PATENT DOCUMENTS

| | | | |
|---|---|---|---|
| 1,529,164 | 3/1925 | Cardwell . | |
| 1,866,452 | 7/1932 | Cogswell . | |
| 3,168,428 | 2/1965 | Dorn et al. | 156/442 |
| 4,450,037 | 5/1984 | Gavronsky | 156/442.2 |

FOREIGN PATENT DOCUMENTS

| | | |
|---|---|---|
| 0100674 | 2/1984 | European Pat. Off. . |
| 0319888 | 6/1989 | European Pat. Off. . |
| 2320484 | 11/1974 | Fed. Rep. of Germany . |
| 1244099 | 9/1960 | France . |

*Primary Examiner*—Richard V. Fisher
*Assistant Examiner*—Brenda Lamb
*Attorney, Agent, or Firm*—Sughrue, Mion, Zinn, Macpeak & Seas

[57] ABSTRACT

A device for selectively moistening the flap of envelopes has a moistening member and a pivoting moistening deflector selectively operable to moisten the flap or not. It further comprises a pivoting slide bar to the front of the moistening member and actuated between a protection position and a retracted position in front of the moistening member. The moistening deflector is adapted to cooperate with the slide bar and the moistening member and is coupled to the bar so that they are actuated virtually simultaneously. The device finds applications in automatic mail handling.

15 Claims, 3 Drawing Sheets

DEVICE FOR SELECTIVELY MOISTENING ENVELOPE FLAPS

BACKGROUND OF THE INVENTION

1. Field of the Invention

The present invention concerns devices for moistening the flap of envelopes during automatic mail handling.

Devices of this kind are coupled to an inserter and in turn feed a device for closing envelopes whose flap has previously been moistened.

The present invention is more particularly concerned with a device for moistening envelope flaps in automatic mail handling machines which is able to moisten envelopes are to be dispensed closed or open.

2. Description of the prior art

A moistening device usually comprises a moistening member to which the gummed side of the flap of an envelope is applied as the envelope moves towards a closing device. The moistening member is supplied from a water reservoir. It is associated with a moistening deflector which forces the flap against the moistening member so that its gummed side is applied firmly to the moistening member.

In known moistening devices with a general organisation as described above the moistening deflector may be pivoted opposite the moistening member. A deflector of this kind is then movable between a rest position and a working position facing the moistening member. It provides for a particular mode of feeding envelopes with their body followed by the flap passing between the moistening member and the deflector in the rest position, so that the body of the envelope is not moistened. Independently of this particular mode of envelope feeding, it also enables the flap to pass freely between it and the moistening member, so that it is not moistened, or forces it against the moistening member to moisten it.

The operation of a moistening device of this kind with a selectively operable pivoted deflector is not entirely satisfactory. Although the deflector is held in the rest position, in which it does not operate on the flap, the natural fold line between the body of the envelope and the flap tends to cause the flap to bend towards the moistening member.

Because of this fold line and the flexibility of the flap, the gummed side of the flap, or at least part of it, may rub against the moistening member and so be moistened when moistening is not required.

An object of the invention is to provide a moistening device for selectively moistening envelope flaps which is relatively inexpensive and easy to implement and which does not have the previously mentioned disadvantages.

SUMMARY OF THE INVENTION

The present invention consists in a device for selectively moistening the flap of envelopes as they move along a path comprising a moistening member and a pivoting moistening deflector which receive between them the flap of each envelope and first means for actuating the moistening deflector between a rest position in which it is spaced from the moistening member and does not operate on the flap and a moistening position in which it forces the flap against an edge of the moistening member which is its front edge with reference to the direction of forward movement of the flap, said device further comprising:

a slide bar having a substantially plane slide surface associated with said moistening member and being on the same side as the moistening member with respect to the flap, said slide bar being pivoted and facing said front edge of said moistening member, and second means for actuating said slide bar between a protection position in which said slide bar adjoins the moistening member with its slide surface flush with said front edge of the moistening member and a retracted position in which slide bar is retracted with its slide surface set back relative to said front edge of the moistening member, and means for controlling said first and second actuator means to place the slide bar in the protection position substantially simultaneously with placing the moistening deflector in the rest position and to place the slide bar in the retracted position substantially simultaneously with placing the moistening deflector in the moistening position.

According to another characteristic of the invention said moistening deflector is a substantially U-shape extrusion or like member.

According to another characteristic of the invention said slide bar is a substantially V-shape extrusion or like member with one branch defining the sliding surface and carrying guide lips at its edge which is its front edge with reference to the direction of forward movement of the flap.

According to another characteristic of the invention the slide bar is articulated to the side walls of a water reservoir in which the moistening member is vertically disposed, the combination of the reservoir, the moistening member and the slide bar being mounted widthways under the path, the moistening deflector being disposed above the path and coupled to the slide bar for simultaneous actuation of the bar into the retracted position and the deflector into the moistening position.

The characteristics and advantages of the invention will emerge more clearly from the following description of one embodiment shown in the appended diagrammatic drawings.

DETAILED DESCRIPTION OF THE INVENTION

Figure 1:
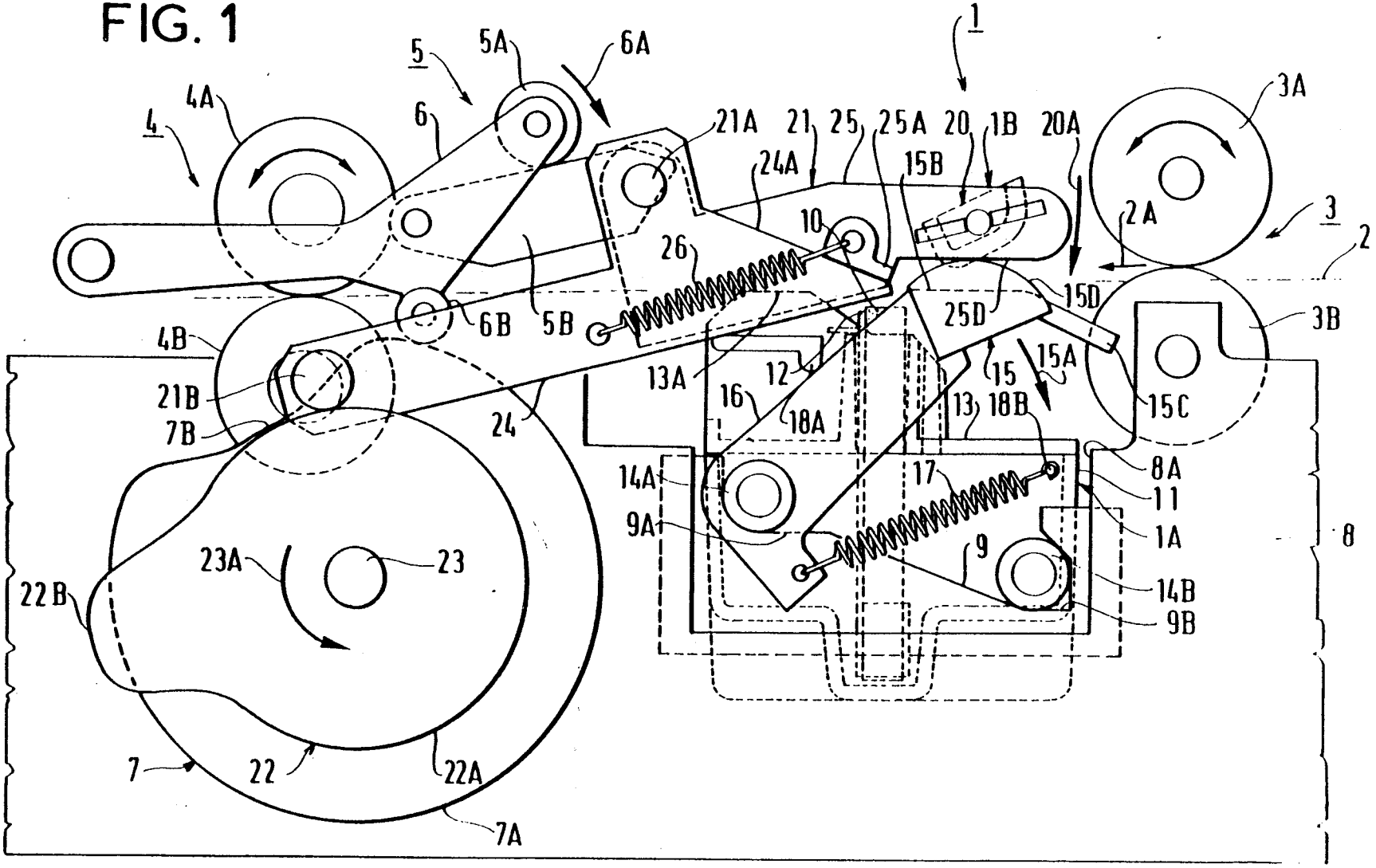
FIG. 1 is a schematic view in elevation showing the device in accordance with the invention for selectively moistening envelope flaps mounted in a mail handling machine.

FIG. 1 is a schematic representation of an automatic mail handling machine fitted with a device in accordance with the present invention for selectively moistening envelope flaps. The machine closes envelopes whose flap has previously been moistened and does not close envelopes whose flap has not been moistened, as required.

The moistening device 1 is disposed on an envelope path 2 of the machine. The path 2 is represented by a chain-dotted line. The envelopes are fed along this path 2 by two pairs of sets of rollers 3A, 3B and 4A, 4B; the moistening device 1 is between the two pairs of rollers. The path 2 is defined by these sets of rollers. The lower sets of rollers 3B and 4B are spring-loaded towards the upper sets of rollers 3A, 4A; if there is no envelope between them and the top sets of rollers they project above the level of the path 2.

In the machine the pair of sets of rollers 3A, 3B at the entry end are part of an envelope filling device 3 which receives each envelope to be filled between its two sets of rollers, holds it while it is filled and then, once filled, feeds it along the path 2.

The pair of sets of rollers 4A, 4B at the exit end contributes with the previous pair to holding and feeding each envelope along the path 2. It also constitutes a device 4 for ejecting each filled and if necessary closed envelope from the path 2.

The arrow 2A shows the forward movement of the envelopes along the path 2, through the moistening device 1, whether their flap is to be moistened or not. Each envelope is fed flat along the path 2 with its body leading and its open flap trailing.

A device 5 for closing envelopes is disposed in the machine between the moistening device and the ejector device 4. The closing device 5 includes a pair of envelope closing presser members 5A and 5B. They are spring-loaded into contact with each other substantially at the ends of a pair of arms 6 articulated at the ends opposite the presser members that they carry. The upper member 5A is a roller and the lower member 5B is an elongate cross-section extrusion or like member. The pair of closing members pivots with respect to the path 2 between a rest position, which is the position shown and in which it is retracted below the path 2, and a closing position. In this closing position it intersects the path 2 with its two members 5A, 5B on either side of the path. The arrow 6A shows the actuation of the pair of closing members from its rest position to its closing position when the flap of the envelope to be closed is level with it on the path 2.

The pair of closing members is actuated in the direction of the arrow 6A and in the opposite direction to return them to their rest position by a pair of cams 7. A roller 6B carried by each arm 6 rests on the corresponding cam. By the closing action (arrow 6A) the flap which was initially flat under the pair of closing members is folded so that it is at substantially 90° to the body of the envelope. The envelope is then closed by moving the envelope in the reverse direction along the path 2, that is in the direction opposite to the direction shown by the arrow 2A. The reverse movement of the envelope causes at least part of it to be inserted between the two closing members. The result of this is to fold the flap down completely and to press it against the body of the envelope, to close it. Further forward movement of the envelope along the path 2 ejects it.

The rollers 3A and 4A are driven in the appropriate direction at the appropriate times to move each envelope in the forward or reverse direction. To this end they are coupled to a reversible motor (not shown). The double-headed arrow with no reference number represents this reversible drive.

If the envelopes are to be ejected without closing them, their flap is not moistened when it passes through the moistening device 1 and is not folded when it passes through the closing device 5. The envelope is ejected with the pair of closing members 5A, 5B held in the rest position and without the reverse movement along the path 2 as previously described.

The device for selectively moistening the flap of envelopes is described with reference to FIG. 1 with regard to its general organisation within the machine and with reference to FIGS. 2 and 3 with regard to its detailed implementation. It comprises a moistening system 1A disposed under the path and an associated moistening deflector 1B disposed above the path.

Its moistening system 1A comprises a moistening member 10 supplied with water from a reservoir 11. The moistening member 10 is mounted on a support 12 which is mounted on the reservoir 11. It projects above the reservoir 11 and extends widthwise across the path 2, slightly below the path 2. The reservoir is closed by a lid 13 through which the moistening member passes. A series of fins 13A extend along the edge of the moistening member that is its rear edge with reference to the forward direction of the envelopes shown by the arrow 2A. The fins project above the level of the moistening member so that they are just flush with the level of the path 2. They constitute an open part of the path 2 immediately to the rear of the moistening members.

The reservoir 11 is disposed under the path 2, directly between two lower flanges like the sketched in flange 8 which define the lower part of the mail handling machine (FIG. 1). It is fixed to these flanges, whether the moistening action is required or not, and is easy to fit into the machine.

For mounting and supporting the reservoir under the path 2 each flange 8 has a notch 8A substantially the same width as the reservoir. Identical projecting fingers 14A and 14B are provided on each of the shorter sides of the reservoir, near two opposite corners. A support part 9 is attached to the inside of each of the flanges; it defines two housings 9A, 9B for retaining the fingers 14A, 14B. The reservoir 11 is mounted directly between the flanges on the support part 9. It is fitted by tilting the reservoir to insert the lower finger 14B on each side into its housing 9B and then sliding the upper finger into its housing 9A, returning the reservoir to the horizontal position. The reservoir is then held without play between the flanges; it can be removed just as easily. The support part 9 is provided to facilitate implementation of the machine, but as an alternative the housings for retaining the reservoir can be formed directly in the edges of the notch 8A in each flange.

In the embodiment shown the moistening member 10 is flat. It comprises, for example, a flat felt-pad, a flat sponge, a flat brush or the like. It is disposed vertically in the reservoir with its lower part immersed in the water and its upper part projecting above the reservoir and the lid, substantially at the level of the path 2. Its support 12 is in the form of a simple holding plate with which one of the larger sides of the member 10 is in contact; the support is held in the reservoir by appropriate means.

As an alternative to this, the moistening member could be a moistening roller whose spindle is secured to the reservoir; the roller is either in direct contact with the water in the reservoir 11 or is supplied with water from the reservoir by an intermediate feed roller, or any equivalent means.

The moistening system 1A of the moistening device 1 further comprises a slide bar 15 associated with the moistening member 10. It extends widthwise transversely under the path 2; it is mounted on the reservoir 11 to the front of the moistening member 10, with reference to the direction of forward movement of the envelopes, and extends along its length. It has a low coefficient of friction for the envelopes. Its side 15B facing towards the path 2 is referred to as the slide surface; it is substantially linear. In the rest position of the moistening device 1 (FIG. 1), the slide surface 15B is just in front of the moistening member 10; it is slightly above the moistening member and substantially in the plane of the path 2.

The slide bar 15 is also carried by the reservoir 11. It is mounted at the end of a pair of arms 16. The arms 16 are articulated to the outside of the shorter sides of the reservoir, each about the projecting finger 14A, which is that furthest to the rear on each shorter side of the reservoir. The slide bar 15 is therefore able to pivot in the direction of the arrow 15A in front of the moistening member 10 about the axis defined by the projecting fingers 14A, from a raised rest position, for the rest or non-moistening position of the device 1 (FIG. 1), to a lowered position referred to as the retracted position of the bar or the moistening position of the device 1 (FIG. 2).

A spring 17 is fixed to each arm 16 and to the corresponding shorter side of the reservoir. It spring-loads each arm so that the bar is held resiliently in its raised rest position. This raised rest position is called its protection position, in which it protects the flexible flaps of envelopes by retaining them to prevent any possibility of contact with the moistening member 10 when they are not required to be moistened. In this raised position and in conjunction with the fins 13A it also holds the body of each envelope as the latter moves in the direction of the arrow 2A through the moistening device, to protect it against any possibility of contact with the moistening member, including during the filling of the envelope.

Figure 2:
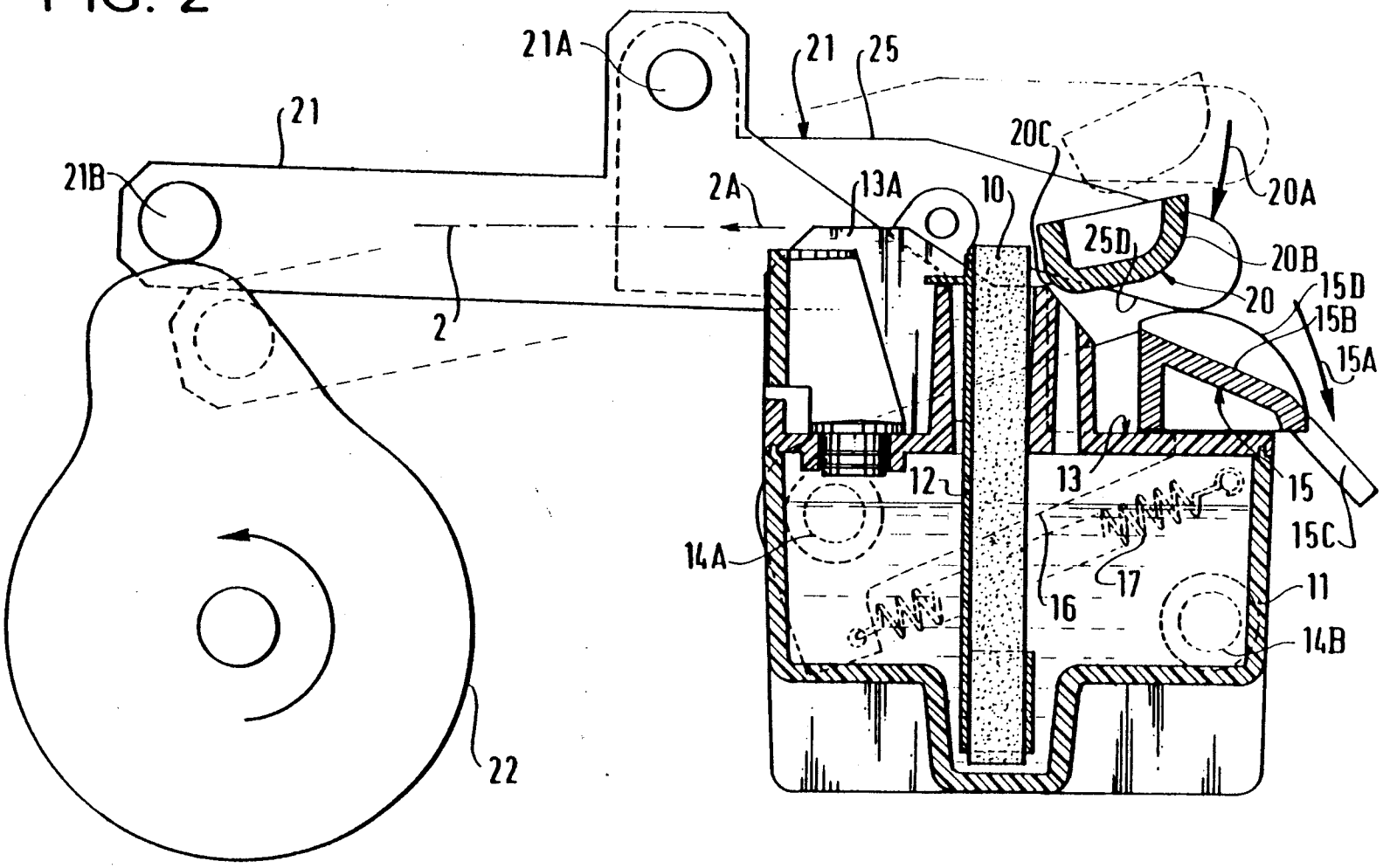
FIG. 2 is a view in cross-section of the moistening device in accordance with the invention shown without the other devices of the FIG. 1 machine and in a moistening configuration.
Figure 3:
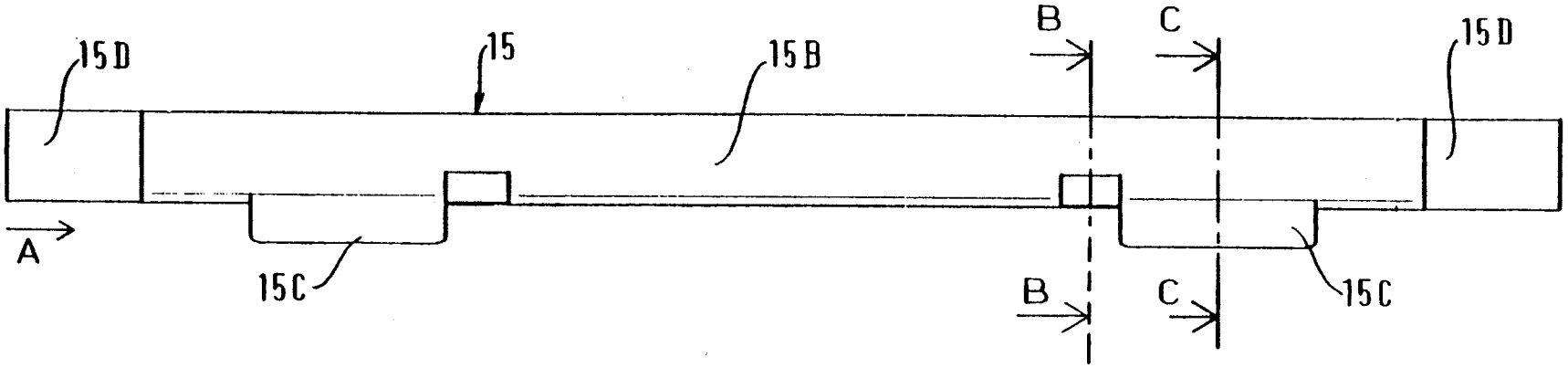
FIG. 3 is a top view of one of the slide bars of the moistening device.
Figure 3C:
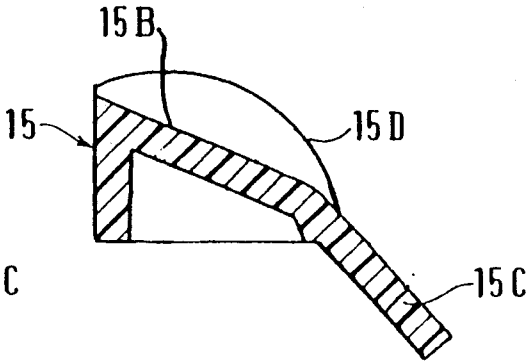
FIGS. 3B and 3C are cross-sections through the slide bar on the respective lines B—B and C—C in FIG. 3.
Figure 3B:
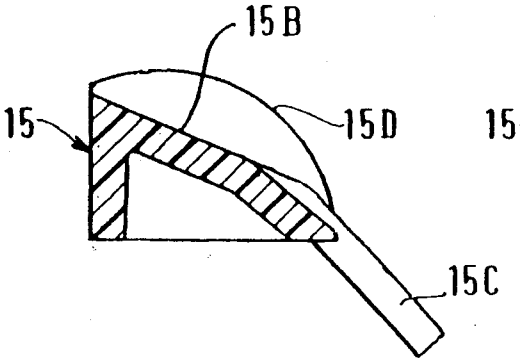
Figure 3A:
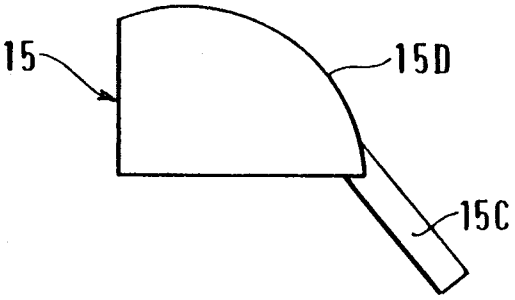
FIG. 3A is a side view of the slide bar in the direction of the arrow A in FIG. 3.

As can be seen in FIGS. 1 and 2, but particularly clearly in FIG. 3 and the views in FIGS. 3A, 3B and 3C, the slide bar has two depending lips 15C on the front edge of its side 15B for envelopes moving in the direction of the arrow 2A. The lips 15C are substantially symmetrical relative to the middle of the front edge of the bar. They facilitate the feeding of each envelope, body first, onto the slide bar in the raised rest position.

The slide bar also has end parts 15D which project above the slide surface 15B and project laterally onto the path 2.

FIGS. 3A through 3C show that the end parts 15D are half-round in shape and that the bar 15 is otherwise of substantially inverted V-shape, with one branch defining the slide surface 15B and the other branch contacting and fixed to the end of the pair of arms 16; each lip 15C is formed from the former branch, which is accordingly made longer.

Referring to FIG. 1, it is seen that two studs 18A, 18B on each shorter side of the reservoir constitute abutments for each arm 16, for the raised protection position and the lowered retracted position, respectively, of the slide bar 15.

FIGS. 1 and 2 shows that in the moistening device 1 the moistening deflector 1B includes a deflector proper 20. It is mounted above the path 2, slightly to the front of the moistening member 10 to cooperate with the latter and with the slide bar 15 with which it is associated and to which its shape is adapted.

The deflector 20 extends transversely of the path 2. It is mounted substantially at the end of a pair of arms 21. The arms 21 extend laterally over the path 2. They are articulated about an intermediate axis 21A above the path 2. Their part at the end opposite the deflector 20 is under the path 2. It carries a roller 21B which bears on the corresponding cam 22. The deflector 20 pivots about the axis 21A from a rest position (the non-moistening position) to a working position (the moistening position). In its rest position it is at a distance above the level of the path 2 enabling successive envelopes to pass freely between it and the slide bar 15 and the moistening member 10. An arrow 28 shows the actuation of the deflector 20 from its rest position to the moistening position. In FIG. 2 the deflector 20 is shown in full line in its moistening position and is sketched in dashed line in its rest position.

In the FIG. 1 mail handling machine the cam 7 controlling closing of the envelopes and the cam 22 controlling moistening are advantageously mounted on a common drive shaft 23. This drive shaft is rotated in the direction of the arrow 23A by a drive motor (not shown) synchronously with the execution of the successive stages of a machine control cycle. The cams 7 and 22 are shown for the rest position of the machine in a reference position sensed by an optical sensor (not shown). They are rotated through a complete revolution for each cycle with or without moistening and corresponding closing or non-closing of the envelope concerned. On the periphery of the cam 7 a first profile 7A is adapted to hold the pair of closing members 5A, 5B in the rest position and a second profile 7B is adapted to hold the same members in the closing position. In a similar way, on the periphery of the cam 22 a profile 22A is adapted to hold the moistening deflector 20 in the rest position and a profile 22B is adapted to hold it in the moistening position. With regard to their actuation in the direction of the arrow 23A, the cams 7 and 22 are constrained to rotate together and all of the profile 22B for holding the moistening deflector 20 in the moistening position is slightly in advance of the profile 7B for holding the closing members 5A, 5B in the closing position.

Thus if the flap is to be moistened the moistening deflector 20 is in the moistening position and the closing members remain in the rest position. The moistening deflector 20 is returned to the rest position by the profile 22A and the closing members 5A, 5B go to the closing position.

If the flap is not to be moistened, the moistening deflector 20 and the closing members 5A, 5B are held in the rest position by the profiles 22A and 7A throughout the presence and passage of the envelope at their level. The roller 21B bears on the profiles 22A until the unclosed envelope is ejected, after which the shaft 23 completes the rotation for this cycle to return the cams to their sensed reference position.

The moistening deflector 20 is a substantially U-shape cross-section extrusion or like member fixed between the pair of arms 21. Its lower surface is inclined above the path and faces the slide bar 15 when the latter is in its rest position. As shown in FIG. 1, the deflector is then above and slightly in front of the moistening member 10 and allows envelopes to pass freely between it and the bar in the raised protection position. Even though they are flexible, the envelope flaps are totally prevented from coming into contact with the moistening member as they pass through the moistening device under these conditions.

Given the direction of forward movement of the letters as shown by the arrow 2A, the front edge 20B and the rear edge 20C (FIG. 2) of the lower surface of the deflector 20 are both rounded, with the front edge having a larger radius of curvature than the rear edge.

When the deflector 20 is in the moistening position and the slide bar is in its retracted position, as shown in FIG. 2, the deflector 20 intersects the level of the path 2, as represented here simply by the upper edge of the moistening member 10 and the fins 13A towards the rear. On its lower surface, which intersects the path slantwise, the front edge 20B guides the flap under the level of the front edge of the moistening member and the rear edge 20C applies the flap against the moistening member. The rear edge 20C, below the level of the path 2, is just in front of the moistening member 10; there is only a very small gap between it and the moistening member. Under these conditions, when an envelope whose body is already to the rear of the moistening member is again fed in the direction of the arrow 2A the deflector causes the flap to be moistened. The front edge and then the lower surface of the deflector guide the flexible flap so as to fold it sharply under the level of the path before allowing it to pass between its rear edge and the moistening member. The deflector's rear edge presses the flap against the moistening member to achieve satisfactory but not excessive moistening. The tops of the fins 13A over which the moistened surface of the flap then passes without pressure do not in any way compromise the quality of moistening just effected.

To allow for possible variations in the thickness of the envelope bodies passing through the moistening device 1, the moistening deflector 20 is spring-loaded relative to the path 2. To this end the arms 21 which carry and actuate it are given some degree of elasticity, as shown in FIG. 1.

To this end, in the embodiment shown, each of the arms 21 comprises an actuator lever 24 carrying the roller 21B and pivoting about the axis 21A and a support arm 25 carrying the deflector 20 and also pivoted about the axis 21A. The lever 24 and the arm 25 are resiliently coupled together by a spring 26. The end of the lever 24 opposite the roller 21B defines a bearing ramp 24A for the arm 25. The latter has a corresponding rib 25A projecting transversely from it and bearing on the ramp 24A. The spring 26 is fixed to the lever 24 and to the rib 25A of the arm 25. It holds the rib 25A against the rib 24A, allowing possible supplementary relative movement of the arm 25 about the axis 21A, depending on the thickness of the envelope under the deflector 20.

In the moistening device, the actuation of the slide bar 15 from its protection position to its retracted position, in the direction of the arrow 15A, is simultaneous with the actuation of the deflector 20 from its rest position to its moistening position, in the direction of the arrow 20A. It is advantageously derived directly from the actuation of the deflector 20.

To actuate the slide bar 15 with the moistening deflector 20, the end of each arm 21 (to be more precise the end of each support arm 25 to which the deflector 20 is attached) is shaped to actuate the slide bar directly to the retracted position, against the action of the spring 17.

This end of the support arm 25 forms a presser member 25D for the half-round end part 15D of the slide bar, the latter therefore serving as an abutment for the presser member 25D.

Of course, the same actuation is achieved if the aforementioned presser member 25D is part of the deflector or if the abutment 15D is part of the arm 16 of the slide bar.

When the moistening deflector 20 is in the rest position the slide bar 15 is in the raised protection position; the presser member 25D is then substantially in contact with the abutment 15D but does not exert any pressure on it. When the moistening deflector 20 is actuated in the direction of the arrow 20A towards its moistening position the presser member 25D operates on the abutment 15D, its lower edge sliding on the circular surface of the abutment, and entrains the slide bar in the direction of the arrow 15A against the action of the spring 17.

The return of the moistening deflector 20 to the rest position by the cam 7 eliminates the pressure exerted by the presser member 25D on the abutment 15D. The spring 17 returns the slide bar to its protection position.

The moistening device is particularly simple to implement and operate. It functions in a simple and reliable way. All its component parts can be molded from plastics material.

The present invention has been described with reference to the embodiment shown in the drawings. It is obvious that modifications of detail may be made thereto and/or some means replaced with other equivalent means without departing from the scope of the invention.

In particular, the deflector may be a substantially half-round extrusion or like member on which is resiliently mounted a member or a series of members extending rearwardly the action of the semi-circular lower edge of this member for proper application of the flap to the moistening member.

THERE IS CLAIMED:

1. Device for selectively moistening flaps of envelopes as they move along a path comprising a moistening member and a pivoting moistening deflector which receive between them the flap of each envelope and first means for actuating the moistening deflector between a rest position in which it is spaced from the moistening member and does not operate on the flap and a moistening position in which it forces the flap against an edge of the moistening member which is the front edge of the moistening member with reference to the direction of forward movement of the flap, said device further comprising:

a slide bar having a substantially plane slide surface associated with said moistening member and being on the same side as the moistening member with respect to the flap, said slide bar being pivoted and facing said front edge of said moistening member, and second means for actuating said slide bar between a protection position in which said slide bar adjoins the moistening member with its slide surface flush with said front edge of the moistening member and a retracted position in which slide bar is retracted with its slide surface set back relative to said front edge of the moistening member, and means for controlling said first and second actuator means to place the slide bar in the protection position substantially simultaneously with placing the moistening deflector in the rest position and to place the slide bar in the retracted position substantially simultaneously with placing the moistening deflector in the moistening position.

2. Device according to claim 1 wherein said moistening deflector is disposed to the front of said moistening member and comprises, from the upstream to the downstream end with reference to the direction of forward movement of the envelopes, means for guiding the envelope flap and means for applying said flap against the front edge of the moistening member to fold said flap in front of said moistening member and to allow said flap to pass pressed against said front edge of said moistening member with said deflector in said moistening position.

3. Device according to claim 2 wherein said moistening deflector is a substantially U-shape extrusion having a base which is inclined to said path and which has semi-circular front and rear edges forming said guide means and said applying means, respectively.

4. Device according to claim 1 wherein said control means comprise:

coupling means between said deflector and said slide bar, projecting laterally onto said path and defining a presser member operated by one of said first and second actuator means and a corresponding abutment operated by the other of said first and second actuator means, a single control member coupled to one of said first and second actuator means, and return means structured and arranged to oppose the action of said presser member on said abutment coupled to the other of said first and second actuator means.

5. Device according to claim 4 wherein said moistening member and said moistening deflector are mounted on respective opposite sides of said path along which each envelope passes flat with its flap trailing and said slide bar is mounted on a water reservoir and is articulated about an axis defined on side walls of said reservoir which is disposed under said path and supports relative to each other and under said path said moistening member and said slide bar for the two positions of said slide bar.

6. Device according to claim 5 wherein said slide bar has a depending lip under said path on the edge of said slide surface which is its front edge with reference to the direction of forward movement of the envelope.

7. Device according to claim 5 wherein said slide bar has a substantially V-shaped cross-section of which one branch of the V-shaped cross-section defines said slide surface and the other branch of the V-shaped cross-section attaches it to said second actuator means articulated to the sides of said reservoir.

8. Device according to claim 7 wherein said slide bar has at each end a semi-circular shoulder projecting onto its slide surface externally to said path to form said abutment.

9. Device according to claim 8 wherein said moistening deflector is carried at the end of a pair of articulated arms constituting said first actuator means and actuating said presser member to a position facing said abutment.

10. Device according to claim 9 wherein said articulated arms are each in two parts, a deflector control lever and a deflector support arm, both articulated about the articulation axis of the moistening deflector and coupled to each other by spring means.

11. Device according to claim 10 wherein said deflector support arm comprises a transversely projecting rib facing said control lever which comprises a bearing ramp for said rib which is held against said ramp by said spring means.

12. Device according to claim 5 wherein said moistening member comprises a flat member disposed vertically in said reservoir and projecting from said reservoir substantially at the level of said path.

13. Device according to claim 12 wherein said moistening member is a felt pad mounted on a support attaching it to the walls of the reservoir.

14. Device according to claim 12 wherein said moistening member is a brush mounted on a support attaching it to the walls of said reservoir.

15. Device according to claim 1 further comprising, associated with said moistening member, rigid fin means extending from the rear edge of said moistening member with reference to the direction of forward movement of the envelopes and flush with the plane of the slide surface of said slide bar when in said protection position.

* * * * *